US006077656A

United States Patent [19]

Majumdar et al.

[11] Patent Number: 6,077,656

[45] Date of Patent: Jun. 20, 2000

[54] PHOTOGRAPHIC PAPER BACKING CONTAINING POLYMERIC PRIMARY AMINE ADDITION SALT

[75] Inventors: Debasis Majumdar, Rochester; Charles C. Anderson, Penfield; Richard A. Castle, Webster, all of N.Y.

[73] Assignee: Eastman Kodak Company, Rochester, N.Y.

[21] Appl. No.: 09/305,933

[22] Filed: May 6, 1999

[51] Int. Cl.[7] ..... G03C 1/89

[52] U.S. Cl. ..... 430/529; 430/527; 430/536

[58] Field of Search ..... 430/527, 529, 430/536

[56] References Cited

U.S. PATENT DOCUMENTS

| | | | |
|---|---|---|---|
| 3,525,621 | 8/1970 | Miller | 430/527 |
| 3,671,248 | 6/1972 | Eldridge et al. | 430/536 |
| 4,266,016 | 5/1981 | Date et al. | 430/527 |
| 4,547,445 | 10/1985 | Asahina et al. | 430/538 |
| 4,695,532 | 9/1987 | Ponticello et al. | 430/539 |
| 5,045,394 | 9/1991 | Saverin et al. | 430/536 |
| 5,156,707 | 10/1992 | Kato et al. | 430/536 |
| 5,221,555 | 6/1993 | Saverin et al. | 427/209 |
| 5,232,824 | 8/1993 | Saverin et al. | 430/529 |
| 5,244,728 | 9/1993 | Bowman et al. | 430/527 |
| 5,360,707 | 11/1994 | Kato et al. | 430/538 |
| 5,405,907 | 4/1995 | Bowman et al. | 430/529 |
| 5,466,536 | 11/1995 | Berner et al. | 430/527 |
| 5,639,589 | 6/1997 | Bauer et al. | 430/539 |
| 5,683,862 | 11/1997 | Majumdar et al. | 430/536 |
| 5,853,965 | 12/1998 | Haydock et al. | 430/536 |
| 5,866,282 | 2/1999 | Bourdelais et al. | 430/536 |
| 5,874,205 | 2/1999 | Bourdelais et al. | 430/534 |

*Primary Examiner*—Richard L. Schilling
*Attorney, Agent, or Firm*—Carl F. Ruoff

[57] ABSTRACT

The present invention is a photographic element including a substrate with a polyolefin resin layer, which is preferably polypropylene, on each surface of the said substrate. The photographic paper includes a print or backmark retaining and spliceable antistatic layer having a dry coverage of from 10 mg/m$^2$ to 10,000 mg/m$^2$ on one of the free surfaces of the polyolefin layers. An imaging layer may be superimposed on the other free surface of the polyolefin layers. The antistatic layer includes a (i) conductive agent, preferably a combination of an alkali metal salt and a polymerized alkylene oxide, (ii) a positively charged colloidal oxide sol and (iii) a film forming binder which is an interpolymer of a primary amine addition salt with a peel strength of 200 g or above on the polyolefin surface on which the antistatic layer of the present invention is to be formed. The antistatic layer is expected to provide surface electrical resistivity of less than 12 log Ω/❑, preferably equal to or less than 11 log Ω/❑, and excellent backmark retention characteristics and spliceability for commercial photofinishing equipment such as the Gretag CLAS 35 printers.

14 Claims, No Drawings

PHOTOGRAPHIC PAPER BACKING CONTAINING POLYMERIC PRIMARY AMINE ADDITION SALT

CROSS REFERENCE TO RELATED APPLICATIONS

This application relates to commonly assigned copending application Ser. No. 09/305,950, filed simultaneously herewith and hereby incorporated by reference for all that it discloses. This application relates to commonly assigned copending application Ser No. 09/306,160, filed simultaneously herewith and hereby incorporated by reference for all that it discloses.

FIELD OF THE INVENTION

This invention relates to antistatic backing layers on imaging elements containing paper support, specifically photographic paper, with print or backmark retaining qualities and spliceability, and to coating compositions suitable for its preparation. Particularly, this invention relates to polyolefin coated photographic paper supports having an image forming layer and a layer capable of (i) providing antistatic characteristics, (ii) receiving and retaining various types of marking including, printing ink and the like, and (iii) being joined through heat splicing in typical photofinishing equipment.

BACKGROUND OF THE INVENTION

The problem of controlling static charge is well known in the field of photography. The accumulation of charge on film or paper surfaces leads to the attraction of dirt which can produce physical defects. The discharge of accumulated charge during or after the application of the sensitized emulsion layer(s) can produce irregular fog patterns or "static marks" in the emulsion. The static problems have been aggravated by the increase in the sensitivity of new emulsions, increase in coating machine speeds, and increase in post-coating drying efficiency. The charge generated during the coating process may accumulate during winding and unwinding operations, during transport through the coating machines and during finishing operations such as slitting and spooling.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc., have been described previously. However, these antistatic layers typically contain a high volume percentage of electronically conducting materials which are often expensive and impart unfavorable physical characteristics, such as color, increased brittleness and poor adhesion, to the antistatic layer.

Besides antistatic properties, an auxiliary layer in a photographic element may be required to fulfill additional criteria depending on the application. For example for resin-coated photographic paper, the antistatic layer if present as an external backing layer should be able to receive prints (e.g., bar codes or other indicia containing useful information) typically administered by dot matrix printers and to retain these prints or markings as the paper undergoes processing. Most colloidal silica based antistatic backings without a polymeric binder provide poor post-processing backmark retention qualities for photographic paper.

Yet another important criterion for photographic paper is its spliceability. Heat splicing of photographic paper rolls is often carried out during printing operations and is expected to provide enough mechanical strength to resist peeling as the web goes at high speed through automatic photographic processors following complicated paths including many turns around transport and guide rollers which puts a great deal of stress on the paper. Heat splicing is typically carried out between the silver halide side of the paper and the antistatic backside of the paper. Poor splice strength can cause a number of problems including jamming of automatic processing equipment resulting in machine shut down. Antistatic backings with poor adhesion to the paper base and/or poor cohesive strength are likely to provide inadequate splice strength.

In general, poor adhesion of the antistatic coating onto the resin-coated paper base may be responsible for a number of problems during manufacturing, sensitizing and photofinishing. Poor adhesion or cohesion of the antistatic backing can lead to unacceptable dusting and track-off. A discontinuous antistatic layer, resulting from dusting, flaking, or other causes, may exhibit poor conductivity, and may not provide necessary static protection. It can also allow leaching of calcium stearate from the paper support into the processing tanks causing build-up of stearate sludge. Flakes of the antistatic backing in the processing solution can form soft tar-like species which, even in extremely small amounts, can re-deposit as smudges on drier rollers eventually transferring to image areas of the photographic paper, creating unacceptable defects.

Although the prior art is replete with patents disclosing various antistatic backings for photographic paper (vide, for example, U.S. Pat. Nos. 3,671,248; 4,547,445; 5,045,394; 5,156,707; 5,221,555; 5,232,824; 5,244,728; 5,318,886; 5,360,707; 5,405,907 and 5,466,536), not all of the aforesaid issues are fully addressed by these inventions. Also, some of the inventions of the prior art may alleviate one or more problems but may aggravate some others. For example, U.S. Pat. No. 3,525,621 teaches that antistatic properties can be given to an aqueous coating composition by practically any silica sol, but preferably a silica of large surface area of the order of 200–235 $m^2/g$ in combination with an alkylaryl polyether sulfonate. However, the high solubility of the alkylaryl polyether sulfonate in aqueous medium causes leaching during processing resulting in poor backmark retention of such antistatic layers. Use of a cation modified colloidal silica has been taught in U.S. Pat. No. 4,895,792 for low surface resistivity backings for photographic elements but in the absence of a suitable polymeric binder these layers are expected to be highly brittle and non-adherent to polyolefin surfaces, particularly polypropylene surfaces, with potential dusting problems. Moreover, U.S. Pat. No. 4,895,792 neglects to teach of any suitable binder that can provide backmark retention characteristics to these antistatic layers.

U.S. Pat. No. 5,244,728 teaches of a binder polymer consisting of an addition product of alkyl methacrylate, alkali metal salt and vinyl benzene which, when incorporated in an antistatic layer for photographic paper, substantially improves backmark retention characteristics but compromises spliceability and track-off characteristics, as demonstrated in U.S. Pat. No. 5,683,862. U.S. Pat. No. 5,466,536 teaches of the use of a mixture of polymers and copolymers with specific acrylic acid content, for good printabilty. However, the high acid number of these polymers make the antistatic layer (or debris thereof) vulnerable for softening in high pH developer solution, and can cause the formation of soft tar-like species discussed herein above.

Moreover, backings developed for one type of polyolefin-coated paper may fail on a different type of polyolefin-coated paper. Therefore, although claims are generally made for both polyethylene and polypropylene coated photographic paper, a vast majority of patents in the art provide examples involving polyethylene coated photographic paper only, and the successful application of these teachings on polypropylene coated photographic paper is often, and even generally, not possible. In general, good adhesion of antistatic layers on a polypropylene surface is more difficult to achieve than on a polyethylene surface. For example, in U.S. Pat. No. 4,547,445 a layer containing gelatin and an inorganic pigment is claimed to have ink-retaining characteristics with good adhesion to polyethylene-coated photographic paper. But, as discussed in U.S. Pat. No. 5,853,965, such a gelatin containing layer is expected to fail adhesion on a biaxially oriented polypropylene-coated photographic paper. However, antistatic layers with good adhesion to a polypropylene surface are expected to have good adhesion to any polyolefin surface including polyethylene. Antistatic layers containing a styrene-maleic anhydride copolymer, colloidal silica and crosslinking compounds containing ethyleneimino groups and/or epoxy rings are disclosed in U.S. Pat. No. 4,266,016, allegedly for good antistatic characteristics and adhesion to both polyethylene and polypropylene surfaces. However, as demonstrated through comparative samples herein below, such antistatic layers provide neither the backmark retention characteristics nor the spliceability currently desired of photographic paper. Moreover, such formulations raise health and safety concerns due to the usage of crosslinking compounds containing ethyleneimino groups.

Thus, it is clear that the prior art does not fully meet the high demands and the diverse need of the industry and requires further innovation. The objective of the present invention is to provide an antistatic backing for photographic elements, particularly polyolefin-coated photographic paper including both polyethylene-coated and polypropylene-coated paper, that renders backmark retaining characteristics as well as spliceability through improved adhesion to the photographic paper, fulfilling the stringent requirements of the industry.

SUMMARY OF THE INVENTION

The present invention is a photographic element including a substrate with a polyolefin resin layer, which is preferably polypropylene, on each surface of the said substrate. The photographic paper includes a print or backmark retaining and spliceable antistatic layer having a dry coverage of from 10 $mg/m^2$ to 10,000 $mg/m^2$ on one of the free surfaces of the polyolefin layers. An imaging layer may be superimposed on the other free surface of the polyolefin layers. The antistatic layer includes a (i) conductive agent, preferably a combination of an alkali metal salt and a polymerized alkylene oxide, (ii) a positively charged colloidal oxide sol and (iii) a film forming binder which is an interpolymer of a primary amine addition salt, with a peel strength of 200 g or above on a polypropylene surface on which the antistatic layer of the present invention is preferred to be formed. The antistatic layer is expected to provide surface electrical resistivity of less than 12 log Ω/❑, preferably equal to or less than 11 log Ω/❑, and excellent backmark retention characteristics and spliceability for commercial photofinishing equipment such as the Gretag CLAS 35 printers.

DETAILED DESCRIPTION OF THE INVENTION

While the invention herein finds particular use in the photofinishing industry to print barcodes or other indicia on the back of paper prints by using dot matrix printers for example, it is useful and suitable for applying print or ink markings to any surface wherein the original surface does not possess the desired characteristics. The application with regard to photofinishing has a particularly stringent requirement because the backing layer must survive photographic processing through the automatic processing devices having the harshest conditions in order to be useful.

In photofinishing applications, the coating compositions must satisfy the following requirements:

1. The ingredients must be compatible. This is a particularly stringent requirement when antistatic agents are employed in the coating composition so that the print retaining layer also possess antistatic properties. The binder polymer in the coating composition is in the form of a latex and can be easily destabilized causing agglomeration of the latex particles to occur.

2. The coatings must be alkali resistant up to a pH of 10 to survive the photographic processing solutions.

3. The coatings must be resistant to discoloration due to processing solutions and/or aging.

4. The coatings must be able to receive and retain ink or other marking materials through the photographic processing.

5. The coatings must not be photoactive and interfere with the light sensitive portions of the photographic paper.

6. The coatings must have resistivity less than 12 log Ω/❑, preferably equal to or less than 11 log Ω/❑, at 50% RH.

7. The backside coating must be spliceable to the frontside in commercially available splicing devices and maintain sufficient peel strength.

8. The coatings must be resistant to track off during conveyance by various roller/nip transport machines during manufacturing of the photographic paper and also in the development processor.

9. The coatings must be block resistant in the rolled form. That is, in preparation of printing paper for use in photographic applications, the paper in processing is rolled upon itself. It is necessary that the write retaining layer does not block together with the opposite surface of the paper support.

10. The coatings must have a stability of at least 6 to 12 months in order to be commercially acceptable.

The coatings and the coating compositions according to this invention satisfy these requirements by utilizing a (i) conductive agent, preferably a combination of an alkali metal salt and a polymerized alkylene oxide, (ii) a positively charged colloidal oxide sol and (iii) a film forming binder which is an interpolymer of a primary amine addition salt, preferably with a peel strength of 200 g or above on polypropylene coated photographic paper.

The electrically conductive agent as per the present invention can include any of the antistatic agents known in the art, including but not limited to those mentioned hereinabove. Ionic conductors are traditionally more cost effective than electronic conductors. Among the ionic conductors, alkali metal salts of polyacids, such as, lithium, sodium or potassium salt of polyacrylic or polymethacrylic acid, maleic acid, itaconic acid, crotonic acid, polysulfonic acid or mix polymers of these compounds, as well as cellulose derivatives are effective conductive agents. The alkali salts of polystyrene sulfonic acid, napthalene sulfonic acid or an alkali cellulose sulfate are preferred. The combination of polymerized alkylene oxides and alkali metal salts, described in U.S. Pat. Nos. 4,542,095 and 5,683,862 incorporated herein by reference, is also a preferred choice. Of the latter group, a combination of a polyethylene ether glycol with lithium nitrate is the most preferred choice for an antistatic agent. The weight ratio of the alkylene oxide to alkali metal salt in the dried antistatic layer can be between 5:95 to 95:5, but preferably between 20:80 and 80:20, and more preferably between 40:60 and 60:40. The combined weight of the alkylene oxide and the alkali metal salt as the electrically conductive agent can be 1–50% of the weight of the dried antistatic layer but preferably between 2–20%, and more preferably between 5–15% of the weight of the dried antistatic layer.

The positively charged, colloidal metal oxide sol used in this invention is preferred to be a colloidal dispersion of silica in aqueous medium, preferably with an average particle size, less than 50 nm, more preferably between 5–25 nm. Commercially available dispersions such as Ludox CL and Ludox CL-P supplied by Du Pont can be used as the source of silica for the present invention. Other useful positively charged, colloidal metal oxide sols include alumina, zirconia, yttria, ceria, and others. Typically, colloidal metal oxide sols used in antistatic coating compositions comprise negatively charged particles such as Ludox AM supplied by Du Pont. However, in the practice of the present invention, such negatively charged colloidal metal sols provide poor solution stability in the presence of the primary amine addition salt interpolymer that is used as the film forming binder.

The binder for the antistatic layer is a film-forming primary amine addition salt interpolymer, preferably with a peel strength of 200 g or above on a polypropylene surface. The peel strength is measured following the method as described in copending U.S. Ser. No. 09/305,950. The binder is a water dispersible interpolymer or latex. More specifically, the interpolymers of the invention contain a polymerized vinyl monomer having a primary amine addition salt component that has the structure

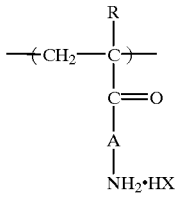

and/or a polymerized vinyl monomer containing an aminostyrene addition salt component that has the structure

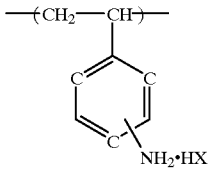

wherein

R is hydrogen or methyl;

A is either —$OR^1$—or

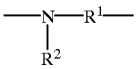

$R^1$ is a straight or branched chain alkylene group of 1 to 6 carbon atoms;

$R^2$ is hydrogen or a straight or branched alkyl or cycloalkyl group of 1 to 10 carbon atoms;

X is an acid anion.

Specific examples of useful monomers having the primary amine addition salt component include 2-aminoethyl methacrylate hydrochloride, 2-aminoethyl acrylate hydrochloride, N-(3-aminopropyl)methacrylamide hydrochloride, and p-aminostyrene hydrochloride.

The interpolymer binder of the invention may contain other vinyl monomers in addition to the monomer having a primary amine addition salt component. These other vinyl monomers include, acrylic and methacrylic acid esters, styrene and its derivatives, butadiene, vinyl and vinylidene halides, acrylonitrile and methacrylonitrile, acrylamides and methacrylamides, and others. In a preferred embodiment, the interpolymer contains a nonionic hydrophilic vinyl monomer and a hydrophobic vinyl monomer in addition to the monomer having a primary amine addition salt. Useful nonionic hydrophilic monomers include 2-hydroxyethyl acrylate, 2-hydroxyethyl methacrylate, vinylimidazole, and vinyl pyrrolidone. Useful hydrophobic vinyl monomers include alkyl acrylates and alkyl methacrylates, and styrene.

The interpolymer of the invention preferably contains from about 2 to about 50 weight percent, preferably from about 2 to about 20 weight percent, of the monomer having the primary amine addition salt component.

The interpolymers of this invention are typically prepared by conventional emulsion polymerization. Alternatively, the interpolymers may be prepared by solution polymerization in a water soluble organic solvent followed by dispersion of the interpolymer in water by addition of the organic solvent solution to water containing a surfactant. Both emulsion and solution polymerization are well known and described, for example, in F. Rodriguez, "Principles of Polymer Systems", 3rd Ed., Hemisphere Publishing Corporation, New York, N.Y. (1989).

The dry weight ratio of colloidal sol:binder polymer in the antistatic layer can vary from 0:100 to 95:5, but preferably between 10:90 to 90:10. The total dry weight % of the colloidal sol and the binder combined should be between 99% and 5% but preferably between 98% and 50% of the antistatic layer.

U.S. Pat. Nos. 4,695,532, 4,689,359, and 5,639,589 describe subbing layers comprising a mixture of gelatin and a primary amine addition salt interpolymer for use on polyester supports. However, in the instant invention the presence of gelatin in the antistatic layer is not desirable since it has a deleterious effect on backmark retention, conductivity and spliceablity of the layer. In addition, the aforementioned prior art references do not teach the use of such an interpolymer for an antistatic layer for polyolefin coated paper support, nor the need for the incorporation of a positively charged metal oxide sol to meet all the demanding requirements of such a layer.

The dry coverage of the antistatic layer of the present invention can be from 10 $mg/m^2$ to 10,000 $mg/m^2$, but preferably from 100 $mg/m^2$ to 1000 $mg/m^2$.

In addition to the (i) conductive agent, preferably a combination of an alkali metal salt and a polymerized alkylene oxide, (ii) a positively charged colloidal oxide sol and (iii) a film forming binder which is an interpolymer of a primary amine addition salt, preferably with a peel strength of 200 g or above on a polypropylene surface, the coating composition of the present invention may include tooth-providing ingredients (vide U.S. Pat. No. 5,405,907, for example), colorants, crosslinking agents, surfactants and coating aids, defoamers, thickeners, coalescing aids, matte beads, lubricants, pH adjusting agents and other ingredients known in the art.

The coating solution for forming the antistatic layer of the present invention on resin-coated photographic paper can be aqueous or non-aqueous; however, aqueous solutions are preferred for environmental reasons. The surface on which the coating solution is deposited for forming the antistatic layer can be treated for improved adhesion by any of the means known in the art, such as acid etching, flame treatment, corona discharge treatment, glow discharge treatment, etc, or can be coated with a suitable primer layer. However, corona discharge treatment is the preferred means for adhesion promotion.

The antistatic layer of the present invention can be formed on any hydrophobic support, for example, synthetic papers such as polypropylene and polystyrene, films such as cellulose acetate, polyethylene terepthalate, polyethylene napthalate, polyvinyl acetate, polystyrene and polycarbonate, resin coated papers comprising paper as a substrate coated on both sides with film forming resins such as polyolefin, polyvinyl chloride, etc. The invention is most suitable for polyolefin coated paper most commonly used in photographic industry, and most particularly polypropylene coated paper.

The aforementioned resin layer may preferably contain, in suitable combination, various additives, for instance white pigments such as titanium oxide, zinc oxide, talc, calcium carbonate, etc., dispersants for example fatty amides such as stearamide, etc., metallic salts of fatty acids such as zinc stearate, magnesium stearate, etc., pigments and dyes, such as ultramarine blue, cobalt violet, etc., antioxidant, fluorescent whiteners, ultraviolet absorbers.

The polyolefin resin coated papers as per this invention can be prepared by extrusion coating or laminating one or more layers of polyolefin resin on substrate paper. The surface of the substrate paper can be treated for improved adhesion prior to resin coating by any of the known methods of the art, e.g., acid etching, flame treatment, corona discharge treatment, glow discharge treatment, etc. The side of the polyolefin resin coated paper on which photographic emulsion layers are provided may have a gloss surface, matte surface, silk-like surface, etc. and the backside usually has but not limited to a dull surface.

Suitable polyolefins for the present invention include polyethylene, polypropylene, polymethylpentene, polystyrene, polybutylene and mixtures thereof. Polyolefin interpolymers, including interpolymers of propylene and ethylene such as hexene, butene and octene are also useful. The present invention is particularly suitable for photographic paper comprising biaxially oriented microvoided polypropylene layer(s), as disclosed in U.S. Pat. Nos. 5,853,965, 5,866,282 and 5,874,205 incorporated in their entirety herein by reference.

The substrate paper may comprise normal natural pulp paper and/or synthetic paper which is simulated paper made from synthetic resin films. However, natural pulp paper mainly composed of wood pulp such as soft wood pulp, hard wood pulp, and mixed pulp of soft wood and hard wood, is preferred. The natural pulp may contain, in optional combination, various high molecular compounds and additives, such as, dry strength increasing agents, sizing agents, wet strength increasing agents, stabilizers, pigments, dyes, fluorescent whiteners, latexes, inorganic electrolytes, pH regulators, etc.

The coating compositions of the invention may be applied by any well known coatings method such as air knife coating, gravure coating, hopper coating, roller coating, spray coating, and the like.

While different photographic elements may require different coverages, the present invention may be applied to both color and black and white photographic papers with adjusted coverage values depending on the particular application.

Test Methods

For resistivity tests, samples are preconditioned at 50% RH 72° F. for at least 24 hours prior to testing. Surface electrical resistivity (SER) is measured with a Keithly Model 616 digital electrometer using a two point DC probe by a method similar to that described in U.S. Pat. No. 2,801,191. An SER value of equal to or less than 11 log Ω/❑, at 50% RH, is considered good for antistatic characteristics for photographic paper.

For backmark retention tests on photographic paper, a printed image is applied onto the coated papers above using a dot matrix printer. The paper is then subjected to a conventional developer for 30 seconds, washed with warm water for 5 seconds and rubbed for print retention evaluation. The following ratings are assigned, with numbers 1–3 indicating acceptably good performance.

1=Outstanding, very little difference between processed and unprocessed appearance.

2=Excellent, slight degradation of appearance

3=Acceptable, medium degradation of appearance

4=Unacceptable, serious degradation of appearance

5=Unacceptable, total degradation.

For spliceability, the peel strength of the antistatic layer was measured using the same method and set-up as described in copending U.S. Ser. No. 09/305,950. Basically, a splice is made between two strips of photographic paper, with the antistatic layer of the present invention on one strip being in contact with the photographic emulsion on the other strip, using a splicing module similar to that used in a typical photofinishing equipment such as the Gretag CLAS 35 printer. Splicing is carried out at a pressure of 0.276 MPa (or 40 psi) with 4 seconds of heating and 4 seconds of cooling, replicating the conditions used in trade. The peel strength of the resultant splice is determined in an Instron machine, using multiple samples of 13 mm width and 10 cm gauge length, as the force (measured in grams) necessary to peel the two strips apart, using a crosshead speed of 50 mm/min. The antistatic layer is considered adequately spliceable if it provides a peel strength of at least 75–100 g and is expected to have good performance in a typical photofinishing equipment.

Sample Preparation

Layers were coated from aqueous solutions of various compositions on corona discharge treated polypropylene coated photographic paper by a suitable coating technique, e.g., hopper coating, wire rod coating, etc. All the antistatic layers of the following working examples comprised of (i) a combination of polyethylene ether glycol Carbowax 3350 supplied by Union Carbide and lithium nitrate in a dry weight ratio of 40:60 as the electrically conducting agent, (ii) positively charged colloidal silica Ludox CL (average particle diameter of 12 nm) or Ludox CL-P (average particle diameter of 22 nm) supplied by Du Pont and (iii) Polymer A, comprising a butyl acrylate-co-2-amynoethyl methacrylate hydrochloride-co-2-hydroxyethyl methacrylate 50/5/45 weight ratio, as per the present invention. The aqueous coating solutions were dried at a temperature less than 180° F.

The present invention is further illustrated by the following examples of its practice.

WORKING EXAMPLES

The following working examples, samples 1 through 10 were formed on polypropylene coated photographic paper, as per the present invention. The details about the composition and the corresponding test data for these samples are provided in Table 1. It is clear that these samples prepared as per the present invention provide good SER values, backmark retention characteristics and spliceability to be effective as antistatic layers on photographic paper.

Comparative Samples

Aqueous solutions were prepared similar to the ones used for coating samples 1 through 6, with the exception of the positively charge colloidal silica being replaced by a negatively charged colloidal silica. These solutions formed unacceptable levels of particulate and were rendered uncoatable. This demonstrates the requirement that positively charged metal oxide sol should be included in the coating composition, as per the present invention.

A sample comprising (i) carbowax and lithium nitrate in a dry weight ratio of 40:60 as the electrically conducting agent and (ii) colloidal silica Ludox CL but no film forming binder which, as per the present invention, should have been an interpolymer of a primary amine addition salt, was formed on polypropylene coated photographic paper. The Carbowax: lithium nitrate: Ludox CL weight ratio in the dry layer was 3.1:4.6:92.3. The layer provided unacceptable backmark retention characteristics (>3), spliceability (<75 g) and physical integrity, demonstrating the inferiority of antistatic layers which do not include a film forming binder which is an interpolymer of a primary amine addition salt.

A sample comprising (i) carbowax and lithium nitrate in a dry weight ratio of 40:60 as the electrically conducting agent, (ii) colloidal silica Ludox AM and (iii) a polymeric binder styrene-co-butyl methacrylate-co-sodium 2 sulfoethylmethacrylate, as described in Example 1 of Table 1 of U.S. Pat. No. 5,244,728, was formed on polypropylene coated photographic paper. The Carbowax:lithium nitrate-:Ludox AM:polymer weight ratio in the dry layer was 3.1:4.6:73.8: 18.5. This was done to evaluate the efficacy of a typical antistatic layer from the prior art, formed on polypropylene coated photographic paper. The layer provided unacceptable backmark retention characteristics (>3), and spliceability (<75 g), demonstrating its inferiority due to non-compliance with the teachings of the current invention.

To evaluate the teachings of U.S. Pat. No. 4,266,016, samples were formed on polypropylene coated photographic paper from the following aqueous composition, as per U.S. Pat. No. 4,266,016. The pH of this composition as 8.

| Component | weight % |
|---|---|
| 5% aqueous solution of styrene-maleic anhydride | 60 |
| 20% solution of colloidal silica | 10 |
| 5% alcoholic solution of a compound containing ethyleneimino groups | 2 |
| 10% solution of anionic surfactant | 4 |
| water | 24 |

These samples prepared as per U.S. Pat. No. 4,266,016, provided unacceptable backmark retention characteristics (>3), and spliceability (<75 g), demonstrating their inferiority. Additionally, these samples had poor physical integrity, and, thus, are prone to dusting, presumably due to their brittleness.

TABLE 1

| Sample | Carbowax dry wt. % | $LiNO_3$ dry wt. % | Ludox CL dry wt. % | Polymer A dry wt. % | Ludox: Polymer A | coverage g/m$^2$ | polyolefin surface | SER log Ω/□ | backmark retention | splice strength, g |
|---|---|---|---|---|---|---|---|---|---|---|
| 1 | 3.1 | 4.6 | 83.1 | 9.2 | 90:10 | 0.25 | polypropylene | 9.6 | 2 | 246 |
| 2 | 3.1 | 4.6 | 73.8 | 18.5 | 80:20 | 0.25 | polypropylene | 9.8 | 2 | 188 |
| 3 | 3.1 | 4.6 | 64.6 | 27.7 | 70:30 | 0.25 | polypropylene | 10.2 | 2 | 200 |
| 4 | 3.1 | 4.6 | 55.4 | 36.9 | 60:40 | 0.25 | polypropylene | 10.2 | 2 | 205 |
| 5 | 3.1 | 4.6 | 46.15 | 46.15 | 50:50 | 0.25 | polypropylene | 10.2 | 2 | 134 |
| 6 | 3.1 | 4.6 | 23.1 | 69.2 | 25:75 | 0.25 | polypropylene | 10.8 | 2 | 138 |
| Sample | Carbowax dry wt. % | $LiNO_3$ dry wt. % | Ludox CL-P dry wt. % | Polymer A dry wt. % | Ludox: Polymer A | coverage g/m$^2$ | polyolefin surface | SER log Ω/□ | backmark retention | splice strength, g |
| 7 | 3.1 | 4.6 | 83.1 | 9.2 | 90:10 | 0.25 | polypropylene | 10.2 | 2 | — |
| 8 | 3.1 | 4.6 | 73.8 | 18.5 | 80:20 | 0.25 | polypropylene | 10.2 | 2 | — |

TABLE 1-continued

| | | | | | | | | | | |
|---|---|---|---|---|---|---|---|---|---|---|
| 9 | 3.1 | 4.6 | 64.6 | 27.7 | 70:30 | 0.25 | polypropylene | 10.7 | 2 | — |
| 10 | 3.1 | 4.6 | 46.15 | 46.15 | 50:50 | 0.25 | polypropylene | 10.9 | 2 | — |

The invention has been described in detail with particular reference to certain preferred embodiments thereof, but it will be understood that variations and modifications can be effected within the spirit and scope of the invention.

What is claimed is:

1. A photographic element comprising:

a support having a polyolefin coating on a first side and a second side;

at least one silver halide emulsion layer superposed on the first side of said support;

an antistatic layer superposed on the second side of the support, said antistatic layer comprising a conductive agent, a positively charged colloidal oxide sol and a polymeric film-forming binder having a peel strength of 200 g or greater said polymeric film-forming binder comprising an interpolymer of a primary amine addition salt.

2. The photographic element of claim 1 wherein the conductive agent comprises alkali metal salts of polyacids or cellulose derivatives.

3. The photographic element of claim 1 wherein the conductive agent comprises polymerized alkylene oxides and alkali metal salts.

4. The photographic element of claim 3 wherein a dry weight ratio of the alkylene oxide to alkali metal salt in the antistatic layer is from 5:95 to 95:5.

5. The photographic element of claim 1 wherein the positively charged colloidal oxide sol comprises an average particle size less than 50 nm.

6. The photographic element of claim 1 wherein the interpolymer of a primary amine addition salt comprises a structure according to formula I or II:

I

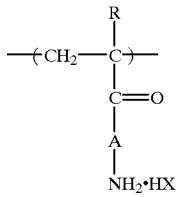

II

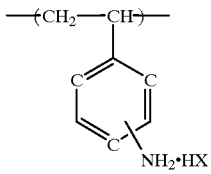

wherein

R is hydrogen or methyl;

A is —$OR^1$— or

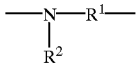

$R^1$ is a straight or branched chain alkylene group of 1 to 6 carbon atoms;

$R^2$ is hydrogen or a straight or branched alkyl or cycloalkyl group of 1 to 10 carbon atoms; and X is an acid anion.

7. The photographic element of claim 1 wherein the interpolymer further comprises vinyl monomers.

8. The photographic element of claim 1 wherein the interpolymer comprises from about 2 to about 50 weight percent of the primary amine addition salt component.

9. The photographic element of claim 1 wherein the antistatic layer further comprises colorants, crosslinking agents, surfactants, coating aids, defoamers, thickeners, coalescing aids, matte beads, lubricants or pH adjusting agents.

10. The photographic element of claim 1 wherein a dry weight ratio of the colloidal oxide sol to polymeric film forming binder is from 0:100 to 95:5.

11. The photographic element of claim 1 wherein a dry coverage of the antistatic layer is from 10 mg/$m^2$ to 10,000 mg/$m^2$.

12. A photographic element comprising:

a support having a polypropylene coating on a first side and a second side;

at least one silver halide emulsion layer superposed on the first side of said support;

an antistatic layer superposed on the second side of the support, said antistatic layer comprising a conductive agent, a positively charged colloidal oxide sol and a polymeric film-forming binder having a peel strength of 200 g or greater said polymeric film-forming binder comprising an interpolymer of a primary amine addition salt.

13. A photographic paper comprising:

a paper support having a polypropylene coating on a first side and a second side;

at least one silver halide emulsion layer superposed on the first side of said paper support;

an antistatic layer superposed on the second side of the paper support, said antistatic layer comprising a conductive agent, a positively charged colloidal oxide sol and a polymeric film-forrning binder having a peel strength of 200 g or greater said polymeric film-forming binder comprising an interpolymer of a primary amine addition salt.

14. A photographic element comprising:

a paper base;

at least one photosensitive silver halide layer superposed on a first side of said paper base; and a layer of biaxially oriented polyolefin sheet between the first side of said paper base and said at least one silver halide layer wherein said biaxially oriented polyolefin sheet comprises a top layer of polyethylene or polypropylene polymer that bonds to gelatin;

an antistatic layer superposed on a second side of the paper support, said antistatic layer comprising a conductive agent, a positively charged colloidal oxide sol and a polymeric film-forming binder having a peel strength of 200 g or greater said polymeric film-forming binder comprising an interpolymer of a primary amine addition salt; and a polypropylene layer between the second side of the paper sheet and the antstatic layer.

* * * * *